United States Patent [19]

Mankins et al.

[11] Patent Number: 4,784,831

[45] Date of Patent: Nov. 15, 1988

[54] HISCOR ALLOY

[75] Inventors: William L. Mankins, Huntington, W. Va.; David G. Tipton, Severna Park, Md.

[73] Assignee: Inco Alloys International, Inc., Huntington, W. Va.

[21] Appl. No.: 892,937

[22] Filed: Aug. 4, 1986

Related U.S. Application Data

[63] Continuation-in-part of Ser. No. 670,767, Nov. 13, 1984, abandoned.

[51] Int. Cl.[4] ..... C22C 38/44; C22C 30/00

[52] U.S. Cl. ..... 420/584; 420/52; 420/53; 148/442; 148/327

[58] Field of Search ..... 420/52, 53, 584; 148/327, 442

[56] References Cited

U.S. PATENT DOCUMENTS

| | | | |
|---|---|---|---|
| 2,448,462 | 8/1948 | Renzoni | 420/52 |
| 2,544,336 | 3/1951 | Linnert | 420/52 |
| 2,597,173 | 5/1952 | Patterson | 420/53 |
| 2,641,540 | 6/1953 | Mohling et al. | 420/53 |
| 2,743,175 | 4/1956 | Talbot | 420/52 |
| 2,744,821 | 5/1956 | Osman | 420/53 |
| 2,770,987 | 11/1956 | Cupler | 420/52 |
| 2,813,788 | 11/1957 | Skinner | 420/584 |
| 2,879,194 | 7/1957 | Eichelberger | 420/53 |
| 2,945,758 | 7/1960 | Jahnke et al. | 420/451 |
| 2,955,934 | 10/1960 | Emery | 420/584 |
| 2,994,605 | 8/1961 | Gill et al. | 420/451 |
| 3,065,068 | 10/1962 | Dyrkacz et al. | 420/53 |
| 3,175,902 | 3/1965 | Ferree | 420/52 |
| 3,184,577 | 5/1965 | Witherell | 420/584 |
| 3,459,539 | 8/1969 | Eiselstein et al. | 420/584 |
| 3,547,625 | 7/1967 | Bieber et al. | 420/584 |
| 3,865,634 | 2/1975 | Bagnoli et al. | 420/108 |
| 3,892,541 | 7/1975 | Jones et al. | 420/584 |
| 4,172,716 | 10/1979 | Abo et al. | 420/52 |
| 4,443,406 | 4/1984 | Sukekawa et al. | 420/586 |
| 4,489,040 | 12/1984 | Asphahani et al. | 420/584 |

FOREIGN PATENT DOCUMENTS

| | | |
|---|---|---|
| 531466 | 5/1946 | United Kingdom . |
| 638007 | 5/1950 | United Kingdom . |
| 741558 | 12/1955 | United Kingdom . |
| 993613 | 6/1965 | United Kingdom . |
| 1508205 | 4/1978 | United Kingdom . |
| 2117792 | 10/1983 | United Kingdom . |

*Primary Examiner*—Deborah Yee

*Attorney, Agent, or Firm*—Raymond J. Kenny; Francis J. Mulligan

[57] ABSTRACT

A highly carburization resistant alloy characterized by good structural stability at elevated temperatures and other desired properties, the alloy containing correlated percentages of iron, nickel, chromium, molybdenum, carbon, titanium, etc.

10 Claims, 2 Drawing Sheets

Figure 1:
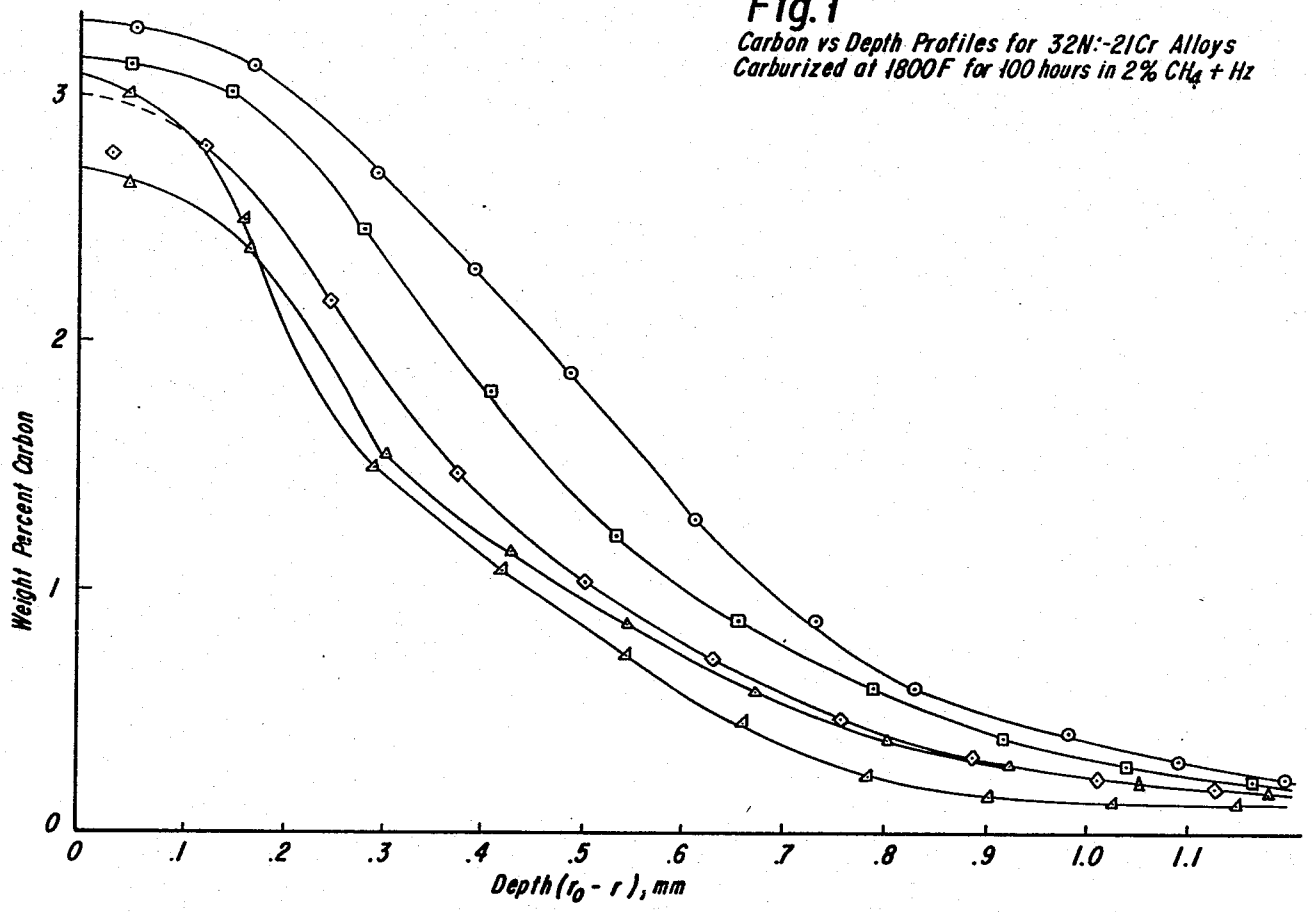

Carbon vs Depth Profiles for 32Ni-21Cr Alloys Carburized at 1800F for 100 hours in 2% $CH_4$ + Hz Fig. 2 Effect of Molybolenum Content on Surface Potential During Carbon Diffusion in 32N: 21Cr Alloys at 1800 F
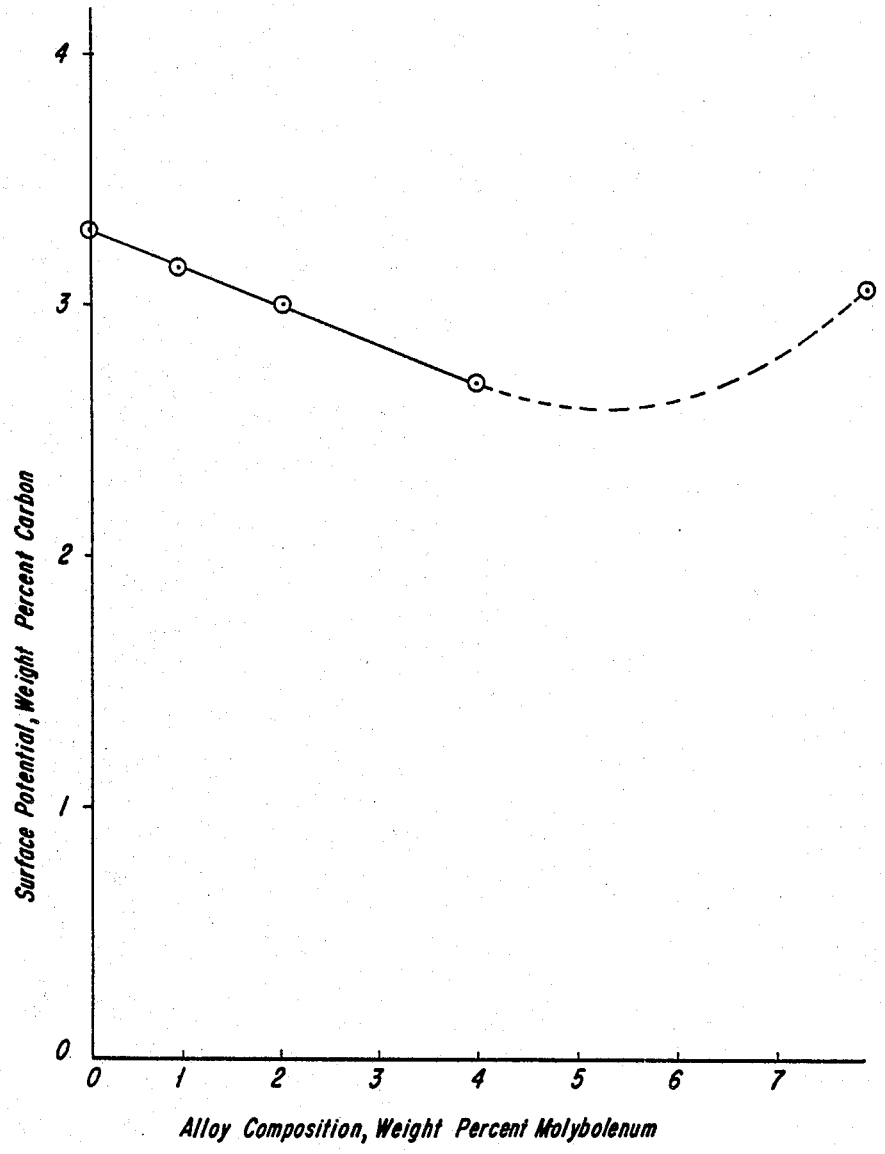

HISCOR ALLOY

This application is a continuation-in-part of U.S. application Ser. No. 670,767 filed Nov. 13, 1984, now abandoned.

The subject invention is directed to a novel iron-nickel-chromium (Fe-Ni-Cr) alloy characterized by a high degree of resistance to carburization and which affords a combination of other desirable metallurgical properties, including structural stability at elevated temperatures, circa 1800°-2000° F., the ability to be both hot and cold worked, good resistance to corrosion including resistance to chloride attacks, etc.

INVENTION BACKGROUND

As is known, iron-base, nickel-chromium alloys are extensively used in a host of diverse applications by reason of one or more (and within limits) strength, ductility, corrosion resistance, etc. Such attributes notwithstanding, this type of alloy generally suffers from an inability to resist satisfactorily the destructive toll occasioned by carburization, a phenomenon by which the alloy structure is environmentally degraded from the surface inward. As a consequence, the load bearing capacity of the alloy is adversely affected as manifested by impaired strength (stress rupture, creep), lowered ductility, etc. Usually the initial attack is along the grain boundaries and this tends to accelerate failure, or at least premature removal of a given alloy component from its operational environment.

In any case, if the carburization problem could be substantially minimized without subverting other properties, such an alloy would find expanded use for such applications as the petrochemical and coal gasification fields, ethylene pyrolysis, etc., areas in which alloys are exposed to a combination of carbonaceous environments and high temperature.

But in addressing the problem of carburization resistance, it would be self-defeating to achieve success at the expense of other desired properties as contemplated herein, e.g., high temperature structural stability over prolonged periods of time, elevated temperature stress-rupture strength, workability, etc.

SUMMARY OF THE INVENTION

It has now been discovered that an iron-nickel-chromium alloy of special chemistry and containing carefullly correlated percentages of iron, nickel, chromium, molybdenum and carbon and certain other constituents discussed herein results in a (i) markedly enhanced carburization resistant material at temperature levels at least as high as 1800°-2000° F. Moreover, the subject alloy is (ii) characterized by excellent hot and cold workability and a low work hardening rate, (iii) not prone to form deleterious amounts of topological closepacked phases prematurely such as sigma, and otherwise offers (iv) structural stability over substantial periods of time upon exposure to elevated temperature. Further, the alloy (v) possesses good tensile and stress-rupture properties at elevated temperatures, is (vi) weldable and (vii) affords a high degree of resistance to pitting attack in aggressive corrosive media.

In addition to the foregoing, it has been also found that the contemplated alloy offers (viii) enhanced oxidation resistance, a phenomenon by which the alloy surface undergoes attack in oxygen-containing environments at high temperature. As a consequence, the material continuously undergoes weight loss, the surface "spalls off". As would be expected the oxidation problem is particularly acute in "thin section" mill product forms, strip, sheet, thin wall tubing, etc.

DESCRIPTION OF THE INVENTION

Generally speaking, the subject invention contemplates an iron-nickel-chromium alloy containing about 24% to 35% nickel, about 19 to 24% chromium, about 1.5 to 4.5% molybdenum, carbon an an amount not exceeding about 0.12%, up to 1.5 or 2% manganese, up to 1% aluminum, up to 1% titanium, up to 1% silicon, up to about 0.3% nitrogen, the balance being essentially iron. As contemplated herein, the expressions "balance" or "balance essentially" in referring to iron content do not preclude the presence of other elements commonly present as incidental constituents, including deoxidizing and cleaning elements, and usual impurities associated therewith in amounts which do not adversely affect the basic characteristics of the alloy.

In carrying the invention into practice, molybdenum plays a major positive role in maximizing resistance to carburization. Advantageously, it should be maintained at a level of about 2% or more in seeking optimum carburization resistance. Percentages much beyond 4% do not offer an appreciable advantage, given cost considerations. However, where resistance to corrosion, particularly chloride attack, is important, the molybdenum can be as high as about 6%.

Chromium imparts resistance to corrosion but should not exceed about 24 or 25% since it lends to sigma formation at elevated temperature and attendant embrittlement problems. A range of 20-23% is quite satisfactory. The total chromium plus molybdenum content preferably does not exceed 26% or 27% since molybdenum also lends to sigma formation. Where high temperature applications are not involved, the chromium plus molybdenum can be extended to 29%.

Nickel contributes to good workability and mechanical properties. Should the nickel level fall much below 24% the stability of the alloy could be impaired, particularly if the chromium and/or molybdenum is at the higher end of their respective ranges. On the other hand, nickel percentages above 35% have been explored (up to 42%) without significant property degradation, but nickel does increase cost. A nickel range of 28% to 33% or 35% is considered most beneficial.

Carbon to the excess, say 0.3%, detracts from pitting resistance. In addition, workability is adversely affected; however, it does add to strength and other properties and, accordingly, a range of about 0.04 or 0.05 to 0.1% is deemed distinctly advantageous, although satisfactory results have been obtained at carbon levels up to 0.15%.

For workability and other benefits titanium should be present but amounts above 1% are not required. A range from 0.1 or 0.2 to 0.75% is quite beneficial. Aluminum can be used as a deoxidizer and as an aid to workability. A range of 0.05 to 0.5% is quite satisfactory.

By so controlling the carbon, titanium, and aluminum as well as the high percentage constituents (Mo, Cr, Ni) the alloys are not only workable but can be produced using air melting practice. This is not to say vacuum processing is precluded but there is an economic advantage to the former.

In terms of such constituents as manganese and silicon, both can be present in amounts up to 2% and 1%, respectively. Higher amounts are unnecessary. Where oxidation resistance is of importance manganese should not exceed about 0.5 to 0.6%. Manganese promotes weldability, particularly at the higher end of its range with aluminum at the lower end of its range. It is deemed that nitrogen, a potent austenite performer, can be present, a range of 0.05 to 0.25% being considered satisfactory. Nitrogen is considered to be beneficial at the lower nickel levels.

The following information and data are given as illustrative of the invention.

Carburization Resistance 14 kg. samples of various compositions were air melted and forged, the compositions being given in TABLE I, Alloys A, B and C being beyond and Alloys 1 and 2 being within the invention.

TABLE I

| Alloy | Mo | C | Cr | Ni | Ti | Al | Mn | Si |
|---|---|---|---|---|---|---|---|---|
| A | 0.01 | .06 | 21.01 | 31.84 | .38 | .30 | .14 | .23 |
| B | 0.92 | .06 | 20.96 | 32.16 | .37 | .32 | .11 | .18 |
| 1 | 1.98 | .12 | 20.27 | 32.27 | .35 | .26 | .26 | .27 |
| 2 | 3.94 | .14 | 19.93 | 32.49 | .31 | .25 | .37 | .32 |
| C | 7.87 | .11 | 20.32 | 32.45 | .34 | .31 | .30 | .46 |

Balance iron plus impurities, e.g., sulfur and phosphorus

In respect of the above alloy compositions, they were subjected to a gaseous carburization test in which specimens were machined into cylinders approximately ½" diameter and 1" in length. These were placed in a tray and put into a muffle type furnace, the temperature being 1800° F. The test was conducted for 100 hours using a gaseous atmosphere of 2% methane plus hydrogen. After exposure, the samples were water quenched and then weighed to determine weight gain data. The results are reported in TABLE II.

TABLE II

Carburization Data: Normalized Weight Gain

| Alloy | Mo (%) | Weight Gain ($mg/cm^2$) |
|---|---|---|
| A | .01 | 11.7 |
| B | 0.92 | 9.3 |
| 1 | 1.98 | 6.3 |
| 2 | 3.94 | 6.2 |
| C | 7.87 | 4.9 |

As can be observed from the data in TABLE II, a rather dramatic improvement obtained in respect of carburization resistance with regard to Alloys 1 and 2. Alloy C (7.87% Mo) showed some further improvement but the cost associated with such molybdenum levels would not likely warrant such percentages on a commercial scale.

Weight gain is essentially a measure of how many atoms of carbon have absorbed but without regard as to the depth of effect. Thus, concentration versus depth profiles were determined and FIG. 1 reflects this information. FIG. 1 confirms, in essence, the data of TABLE II. As is manifest, with increasing molybdenum percentages the penetration profile shrinks indicating that less diffusion has occurred.

FIG. 2 depicts surface potential versus molybdenum content. This may be viewed as the chemical effect of molybdenum on carbon diffusion, or specifically the effect of molybdenum on gas-metal reaction at the surface, carbon solubility, or carbon activity coefficient. The surface potential appears to be a quite linear decreasing function of molybdenum, at least up to 4%. The behavior at 8% molybdenum is not clearly understood.

We have also determined that molybdenum decreases the carbon diffusion coefficient.

Oxidation Resistance

TABLES III (chemistry) and IV (data) afford a comparison of the oxidation resistance behavior of alloys within the invention versus commercial (control) alloys of somewhat similar composition.

The oxidation test was one of cyclic oxidation using 14 kg. samples (air melted) forged to flats, hot rolled to 0.312 inch and cold rolled to 0.125 inch. The test comprised subjected specimens for 15 minutes at 2000° F., coolling for 5 minutes in air, heating again to 2000° F., holding for 15 minutes, again cooling 5 minutes in air, until testing was completed. Specimens were checked at 100 hr. intervals. Prior to test the specimens were annealed at 2150° F. and water quenched. Oxide was removed by grinding to 120 grit.

TABLE III

| Alloy | Mo % | C % | Cr % | Ni % | Ti % | Al % | Mn % | Fe % |
|---|---|---|---|---|---|---|---|---|
| 3 | 1.89 | .05 | 20.82 | 32.73 | .30 | .32 | .09 | Bal. |
| 4 | 3.92 | .04 | 20.85 | 32.37 | .40 | .29 | .08 | Bal. |
| D | 9.62 | .04 | 20.70 | 32.40 | .35 | .28 | .08 | Bal. |
| Control #1 | | .05 | 21 | 32 | .5 | .5 | 1.0 | Bal. |
| Control #2* | .01 | .05 | 20.93 | 32.93 | .5 | .45 | .10 | Bal. |

*Contained .54 Si and .07 Cu

TABLE IV

2000° F. Cyclic Oxidation Data
Weight Change/Unit Area, $mg/cm^2$

| Alloy | 100 hr. | 200 hr. | 300 hr. | 400 hr. | 500 hr. | 700 hr. | 1000 hr. | Depth of Attack in. |
|---|---|---|---|---|---|---|---|---|
| 3 | +1.0 | +1.4 | +2.0 | +2.3 | +1.7 | −24.9 | −81.7 | .004 |
| 4 | +1.1 | +1.6 | +2.2 | +2.6 | +3.1 | −15.5 | −66.9 | .006 |
| D | −0.3 | −0.4 | −0.2 | −0.2 | −0.8 | −8.9 | −40.2 | .005 |
| Control #1 | +2.6 | −40.1 | −86.6 | −124.4 | −156.8 | −223.1 | −316.4 | .020 |
| Control #2 | +1.5 | −1.7 | −25.0 | −65.3 | −98.8 | −180.9 | −294.5 | .019 |

As will be observed, the alloys within the invention compared more than favorably with the Control alloys. Maintaining manganese at low levels, i.e., below 0.6 or 0.5% contributes to enhanced oxidation resistance.

Cyclic oxidation test on Alloy 4 in the form of 0.030 thin gage sheet also compared favorably with Control Alloy No. 1 as reflected in TABLE V.

TABLE V

1000° F. Cyclic Oxidation Data, .030 Inch Sheet

| Alloy | 100 hr. | 200 hr. | 300 hr. | 400 hr. | 500 hr. | 700 hr. | 1000 hr. |
|---|---|---|---|---|---|---|---|
| 4 | +1.6 | −0.1 | −21.1 | −26.4 | 42.5 | −75.5 | −95.3 |

TABLE V-continued

| Alloy | 1000° F. Cyclic Oxidation Data, .030 Inch Sheet 100 hr. | 200 hr. | 300 hr. | 400 hr. | 500 hr. | 700 hr. | 1000 hr. |
|---|---|---|---|---|---|---|---|
| Control #1* | +2.6 | −40.1 | −86.6 | −124.4 | −156.8 | −223.1 | −316.4 |

*.125 gage

Testing of thin gage specimens is markedly more severe because warpage is much more likely to occur on cooling thus increasing the tendency for oxide scaling.

Structural (Phase) Stability

In TABLE VI infra are given the results of various impact (ability to absorb impact) tests. Charpy V-Notch impact testing is often used as a means of predicting whether an alloy will undergo embrittlement on being exposed to elevated temperatures for prolonged periods.

While a 1000 hour test period might normally be deemed sufficiently severe, tests were also conducted for 3000 hours at temperatures of 1400° F. and 1500° F. The composition of the alloys tested are given in TABLE III.

TABLE VI

| Temperature (°F.) | Time (hr.) | Charpy V-Notch, ft. lbs. Alloy 3 | Alloy 4 | Alloy D |
|---|---|---|---|---|
| 1200 | 1000 | 114 | 78 | 18 |
| 1400 | 1000 | 65 | 56 | 3 |
| 1400 | 3000 | 90 | 14 | * |
| 1500 | 1000 | 87 | 36 | * |
| 1500 | 3000 | 81 | 17 | * |

*Discontinued
Samples annealed at 2150° F., water quenched prior to exposure

The alloys of the invention (Alloys 3 and 4) were quite resistant to premature embrittlement as evident from TABLE VII. Even upon 3000 hour testing the alloys within the invention performed satisfactorily. Alloy D (9.62% Mo) did not stand up at 1400° F./1000 hr. It was sigma prone.

To further study stability, a commercial size (450 lb.) centrifugally cast hollow billet was extruded to a tube shell and cold worked to 2.25 inch diameter×0.270 inch wall tube. (Composition: 0.06 C., 0.03 Mn, 0.33 Si, 31.98 Ni, 21.55 Cr, 0.18 Al, 0.32 Ti; 3.12 Mo, Fe balance). The specimen was annealed at 2150° F. for an hour and air cooled prior to test. The tube was rupture tested at 1200° F./12 ksi for the tremendously long period of 26,394 hours (3 years) and then discontinued no failure having occurred. A metallographic study showed $M_{23}C_6$ carbides and very fine particles of sigma within the grains which were deemed innocuous, particularly since a portion of the specimen was placed in a vise and bent to ascertain if embrittlement had occurred. The ductile nature of the specimen was obvious.

Additional stress-rupture data as well as tensile properties are given in TABLE VI-A and TABLE VI-B, respectively, for tubing at the above composition. In this instance the tubing was 3.25 inch diameter×0.400 inch wall thickness. Both the as-extruded and as-extruded plus anneal (2150° F.) conditions are reported.

TABLE VI-A

| Temperature, °F. | Stress, ksi | Rupture Life, hours | Elongation, % | Reduction Area % |
|---|---|---|---|---|
| Extruded Plus 2150° F. Anneal/1 Hour | | | | |
| 1200 | 20 | 2378.3 | 19.8 | 25.5 |
| 1200 | 30 | 257.7 | 39.4 | 56.6 |
| 1200 | 40 | 51.8 | 31.5 | 37.9 |
| 1400 | 10 | 2211.6 | 39.5 | 62.3 |
| 1400 | 20 | 43.0 | 47.5 | 73.2 |
| 1600 | 6 | 636.8 | 24.0 | 42.4 |
| 1800 | 2 | 1679.4 | — | — |
| 2000 | 1 | 891.8 | 13.4 | 7.8 |
| As-Extruded | | | | |
| 1200 | 20 | 3353.2 | 18.5 | 44.6 |
| 1200 | 30 | 257.9 | 53.2 | 69.0 |
| 1200 | 40 | 42.8 | 45.1 | 63.2 |
| 1400 | 10 | 1689.1 | — | — |
| 1400 | 20 | 39.7 | 51.3 | 82.0 |
| 1600 | 6 | 621.5 | 23.0 | 45.8 |
| 1800 | 2 | 2040.5 | 17.3 | 7.0 |
| 2000 | 1 | 1041.1 | 19.7 | 15.5 |

TABLE VI-B

| Temperature, °F. | 0.2% Y.S., ksi | U.T.S., ksi | Elongation, % | Reduction Area, % |
|---|---|---|---|---|
| Extruded Plus 2150° F. Anneal/1 Hour | | | | |
| Room Temp. | 41.0 | 83.3 | 54 | 76.7 |
| 1000 | 31.7 | 68.8 | 51 | 46.7 |
| 1200 | 26.7 | 60.8 | 49.2 | 62.8 |
| 1400 | 28.5 | 44.1 | — | 62.4 |
| 1600 | 22.4 | 28.3 | 56.4 | 73.3 |
| 1800 | 14.2 | 15.4 | 80 | 86.3 |
| 2000 | 5.0 | 8.1 | 86.8 | 84.9 |
| As-Extruded | | | | |
| Room Temp. | 54.0 | 81.7 | 48 | 81 |
| 1000 | 42.4 | 67.3 | 43.8 | 36.8 |
| 1200 | 39.0 | 60.9 | 44.4 | 51.6 |
| 1400 | 37.2 | 45.7 | 43.8 | 74.2 |
| 1600 | 22.4 | 27.2 | 81.0 | 87.7 |
| 1800 | 9.0 | 12.8 | 88.6 | 84.7 |
| 2000 | 3.7 | 7.2 | 65.0 | 75.5 |

The above data reflect that the subject alloy affords high strength at elevated temperatures.

Weldability

Compositions for weldability are given in TABLE VII. In this connection, two alloy series were evaluated one involving variations in aluminum and manganese (Alloys 5–8), the other (Alloys A, B, 1, 2 and C) exploring the effect of molybdenum.

Material was provided as ½" thick×2" wide hot forged flats which were overhauled and rolled to 0.310" thick×2" wide for Varestraint test samples. Included for purposes of comparison is a well known commercial alloy (Control).

TABLE VII

| Alloy | Mo | C | Cr | Ni | Ti | Al | Mn | Fe |
|---|---|---|---|---|---|---|---|---|
| A | 0.01 | .06 | 21.01 | 31.84 | .38 | .30 | .14 | Bal. |
| B | 0.92 | .06 | 20.96 | 32.16 | .37 | .32 | .11 | Bal. |
| 1 | 1.98 | .12 | 20.27 | 32.27 | .35 | .26 | .26 | Bal. |
| 2 | 3.94 | .14 | 19.93 | 32.49 | .31 | .25 | .37 | Bal. |
| C | 7.87 | .11 | 20.32 | 32.45 | .34 | .31 | .30 | Bal. |
| 5 | 3.93 | .05 | 21.32 | 32.14 | .40 | .27 | .07 | Bal. |
| 6 | 3.82 | .05 | 21.08 | 32.25 | .31 | .04 | .15 | Bal. |
| 7 | 3.90 | .05 | 20.50 | 32.14 | .42 | .30 | .56 | Bal. |
| 8 | 3.87 | .08 | 20.88 | 32.25 | .28 | .04 | .56 | Bal. |
| Control Alloy | .26 | .08 | 19.89 | 32.80 | .44 | .32 | .83 | Bal. |

Contained 0.04% Cu. All heats contained small amounts Si
Bal. = balance and impurities A travel speed of 5"/min, an amperage of 190 amps and a voltage over the range of 13.8–15.0 volts were employed. The Varestraint test, one of relatively considerable severity, was conducted on both a 50" and 25" radius block with the results given in TABLE VIII.

TABLE VIII

| | | Varestraint Test Results | | | | | | | | |
|---|---|---|---|---|---|---|---|---|---|---|
| | | 50 Inch Radius Block | | | | | 25 Inch Radius Block | | | |
| Alloy | Test Thick | MCL (mils) | Avg. MCL | TCL (mils) | Avg. TCL | Test Thick | MCL (mils) | Avg. MCL | TCL (mils) | Avg. TCL |
| A | .303 | 0 | | 0 | | .302 | 18 | | 79 | |
| | .304 | 0 | 0 | 0 | | .303 | 13 | 15 | 50 | 75 |
| | .303 | 0 | 0 | 0 | | .304 | 15 | | 96 | |
| B | .304 | 0 | | 0 | | .314 | 12 | | 26 | |
| | .309 | 0 | 0 | 0 | 0 | .315 | 15 | 14 | 45 | 53 |
| | .308 | 0 | | 0 | | .313 | 15 | | 87 | |
| 1 | .314 | 0 | | 0 | | .314 | 30 | | 105 | |
| | .311 | 0 | 0 | 0 | 0 | .312 | 20 | 24 | 32 | 84 |
| | .310 | 0 | | 0 | | .311 | 22 | | 124 | |
| 2 | .309 | 0 | | 0 | | .320 | 35 | | 68 | |
| | .314 | 0 | 0 | 0 | 0 | .320 | 25 | 31 | 93 | 86 |
| | .314 | 0 | | 0 | | .315 | 33 | | 118 | |
| C | .314 | 0 | | 0 | | .314 | 36 | | 161 | |
| | .315 | 0 | 7 | 0 | 13 | .313 | 28 | 34 | 97 | 123 |
| | .314 | 21 | | 40 | | .313 | 38 | | 112 | |
| 5 | .313 | 0 | | 0 | | .313 | 12 | | 20 | |
| | .313 | 0 | 0 | 0 | 0 | .315 | 26 | 19 | 114 | 87 |
| | .313 | 0 | | 0 | | .316 | 28 | | 128 | |
| 6 | .300 | 0 | | 0 | | .299 | 28 | | 96 | |
| | .300 | 0 | 0 | 0 | 0 | .302 | 26 | 15 | 123 | 117 |
| | .303 | 0 | | 0 | | | | | | |
| 7 | .313 | 0 | | 0 | | .314 | 38 | | 126 | |
| | .315 | 0 | 0 | 0 | 0 | .313 | 22 | 30 | 65 | 96 |
| 8 | .304 | 0 | | 0 | | .306 | 16 | | 63 | |
| | .307 | 0 | 0 | 0 | | .304 | 0 | 8 | 0 | |
| | .305 | 0 | | 0 | | — | — | | — | |
| Con- | .306 | 47 | | 101 | | .303 | 38 | | 197 | |
| trol | .306 | 26 | 35 | 41 | 71 | .303 | 38 | | 197 | |
| Alloy | .309 | 32 | | 72 | | .307 | 30 | | 131 | |

MCL - Maximum Crack Length
Amperage 190
TCL - Total Crack Length
Voltage 13.8–15.0
Travel Speed 5"/min.

All the specimens performed at least as (more) satisfactorily as the commercial control alloy. Of the molybdenum series, the high molybdenum material (Alloy C, 7.87% Mo) was more susceptible to cracking. Regarding the Al/Mn series, the low aluminum, high manganese material (Alloy 8) was the most crack resistant. Accordingly, by using molybdenum levels within the invention, particularly with low aluminum, 0.04 to 0.35%, and high manganese, say 0.3 to 0.6%, weldability is improved.

Pitting Corrosion Resistance

Data reported in TABLE IX give an indication of pitting resistance. Samples were cold-rolled to 0.125" and annealed at either 2150° F. or 2350° F. for one hour, followed by water quenching. Specimens (approximately 7"×3") were prepared by grinding to 320 grit and then exposed 4 hours at 95° F. in acidified 10.8 2/o $FeCl.6H_2O$ (Smith Test). After exposure, weight loss per unit surface area was determined and the specimens visually evaluated for the appearance of pits.

TABLE IX

| Alloy | C % | Mo % | Cr % | Ni % | Ti % | Al % | Mn % | Si % | Pitting | Mg/cm$^2$ |
|---|---|---|---|---|---|---|---|---|---|---|
| E | .29 | 1.98 | 20.86 | 32.70 | .42 | .33 | .11 | 1.84 | Yes | n.d. |
| 9 | .05 | 1.89 | 20.82 | 32.73 | .30 | .32 | .09 | .20 | Yes | n.d. |
| F | .28 | 3.79 | 20.95 | 32.28 | .29 | .29 | .07 | .17 | Yes | 7.773 |
| 10 | .04 | 3.92 | 20.85 | 32.37 | .40 | .29 | .08 | .21 | No | 0.334 |

TABLE IX-continued

| Alloy | C % | Mo % | Cr % | Ni % | Ti % | Al % | Mn % | Si % | Pitting | Mg/cm$^2$ |
|---|---|---|---|---|---|---|---|---|---|---|
| G | .28 | 2.26 | 20.86 | 32.47 | .32 | .31 | .07 | .18 | Yes | 10.181 |

n.d. = Not determined

As can be seen from TABLE IX, carbon at the higher levels is detrimental to pitting resistance. It detracts from the resistance to pitting imparted by molybdenum. Accordingly, where corrosion resistance is important carbon should not exceed about 0.12%. Also, for such purposes the molybdenum can be extended to 6%.

Workability

Irrespective of carburization resistance and other attributes, if the alloys are unworkable, then they would find little utility. However, alloys within the invention are both hot and cold workable. Using Alloys 3 and 4 of TABLE III, these alloys forged readily and the forgings upon inspection were of high quality.

Hardness data are given in TABLE X for given annealing temperatures. Also included is hardness in the cold worked condition. In this connection, specimens were cold rolled to about 0.125" thick from thickness given in TABLE XI.

TABLE X

| Alloy | Annealing Heat Treatment, °F. | Annealing Hardness $R_b$ | As Cold Worked Hardness, $R_c$ |
|---|---|---|---|
| 3 | 2150/1 hr. | 66.5 | 33 |
| 4 | 2150/1 hr. | 71.5 | 33 |

TABLE XI

| Alloy | Starting Thickness | Final Thickness | % Reduction |
|---|---|---|---|
| 3 | .524 | .126 | 76 |
| 4 | .473 | .127 | 73 |

Considering both the data from TABLES X and XI, the hardness measurements reflect that the alloys are relatively readily workable. From TABLE XI, it will be noted that cold reductions of more than 60% could be achieved without intermediate annealing. This together with the hardness data reflects that the alloys have excellent cold workability and a low work hardening rate. It might be added that high carbon is not beneficial to workability.

Although the present invention has been described in connection with preferred embodiments, it is to be understood that modifications and variations may be restored to without departing from the spirit and scope of the invention, as those skilled in the art will readily undestand. Such modifications and variations are considered to be within the purview and scope of the invention and appended claims.

We claim:

1. A (i) wrought, (ii) weldable iron-nickel-chromium alloy characterized by excellent (iii) hot and (iv) cold workability (v) a low work hardening rate, (vi) high strength at elevated temperature and being further characterized at temperatures at least as high as 1800° to 2000° F. by (vii) good carburization and (viii) oxidation resistance together with (ix) good structural stability when exposed at a temperature at least as high as 1200° F. for at least 1000 hours, the alloy consisting essentially of (weight percent) about 28 to 35% nickel, 20 to 24% chromium, at least 1.5% and up to 4.5% molybdenum, carbon present up to 0.12%, titanium from 0.2 to 1%, up to 1% aluminum, up to 2% manganese, up to 1% silicon and the balance iron, said alloy being in contact with a carbonaceous environment at high temperature which is conducive to causing carburization.

2. The alloy of claim 1 containing 29 to 33% nickel, 20.5 to 23% chromium, about 2 to 4% molybdenum, 0.04 to 0.1% carbon, 0.2 to 0.5% titanium and about 0.05 to 0.75% aluminum.

3. The alloy of claim 1 in which the sum of chromium plus molybdenum does not exceed 26%, manganese does not exceed 0.6% and aluminum is from 0.05 to 0.5%.

4. The alloy of claim 1 in which weldability is enhanced by controlling the percentages of aluminum and manganese such that the aluminum is from 0.04 to 0.35% and the manganese is about 0.3 to 0.6%.

5. A weldable, iron-nickel-chromium alloy characterized by excellent hot and cold workability, a low work hardening rate, which strength at elevated temperature and being further characterized at temperatures at least as high as 1800° to 2000° F. by good carburization and oxidation resistance together with good structural stability when exposed to temperatures at least as high as 1200° F. for at least 1000 hours, the alloy consisting essentially of (weight percent) about 28 to 35% nickel, 19 to 23% chromium, at least 1.5% and up to about 4% molybdenum, carbon present up to 0.15%, titanium present from 0.25 to 1%, up to 1% aluminum, up to 2% manganese, up to 1% silicon and the balance essentially iron.

6. The alloy of claim 5 in which the manganese content does not exceed 0.6% to thereby enhance the property of oxidation resistance.

7. The alloy of claim 5 in which the carbon content is at least about 0.06% to provide greater strength properties.

8. A weldable, hot and cold workable, iron-nickel-chromium alloy in the wrought condition characterized by a low work hardening rate, high strength at elevated temperature and further being characterized by good carburization and oxidation resistance at temperatures at least as high as 1800° F. together with good structural stability when exposed at a temperature at least as high as 1200° F. for at least 1000 hours, the alloy consisting essentially of (weight percent) about 28 to 35% nickel, 19 to 24% chromium, at least 1.5% and up to about 4% molybdenum the sum of the chromium plus molybdenum not exceeding 27%, carbon present up to 0.12%, from 0.2 to 1% titanium, up to 1% aluminum, up to 2% manganese, up to 1% silicon and the balance iron.

9. The alloy of claim 8 which contains at least 0.05 aluminum and in which the chromium plus molybdenum does not exceed about 26%.

10. A weldable, hot and cold workable iron-nickel-chromium alloy characterized by a low work hardening rate, high strength at elevated temperature and further being characterized by good carburization and oxidation resistance at temperatures at least as high as 1800° F. together with good structural stability at a temperature at least as high as 1200° F. for at least 1000 hours, the alloy consisting essentially of (weight percent) about 28 to 35% nickel, 19 to 24% chromium, at least 1.5% and up to about 4% molybdenum, carbon present up to 0.12%, up to 1% titanium, from 0.05 to 1% aluminum, up to about 0.6% manganese, up to 1% silicon and the balance iron.

* * * * *